United States Patent [19]

Barny

[11] 3,945,305

[45] Mar. 23, 1976

[54] CARDBOARD BLANK FOLDING MACHINE

[75] Inventor: Jean-Jacques Barny, Lyon, France

[73] Assignee: S.A. Martin, Saint-Priest, France

[22] Filed: Feb. 25, 1975

[21] Appl. No.: 552,781

[30] Foreign Application Priority Data

Feb. 28, 1974 France ..... 74.06762

[52] U.S. Cl. ..... 93/49 R; 93/59 PL; 93/84 R

[51] Int. Cl.[2] ..... B31B 1/26

[58] Field of Search ..... 93/49 R, 84 R, 59, 67

[56] References Cited

UNITED STATES PATENTS

| | | | |
|---|---|---|---|
| 1,986,857 | 1/1935 | Roberts et al. | 93/49 R |
| 2,291,063 | 7/1942 | Staude et al. | 93/49 R |
| 2,547,963 | 4/1951 | Neal | 93/49 R X |
| 2,871,772 | 2/1959 | Nelson | 93/49 R X |
| 3,618,479 | 11/1971 | Shields | 93/49 R X |

*Primary Examiner*—Othell M. Simpson
*Assistant Examiner*—Leon Gilden
*Attorney, Agent, or Firm*—Haseltine, Lake & Waters

[57] ABSTRACT

In a cardboard blank folding machine for folding up the extreme transverse panels of a blank, e.g. for a carton, along longitudinal fold lines, and comprising a pair of longitudinal beams whose spacing is adjustable in dependence on the spacing of said fold lines, a pair of lateral elements whose spacing relative to said longitudinal beams is adjustable in dependence on the transverse dimensions of said extreme transverse panels, and a pair of folding bars each forming a longitudinally extending ramp for forcing said extreme transverse panels to fold about said fold lines as said blank passes along said machine, the improvement wherein said folding bars are each supported at the upstream end on a support fixed to said corresponding lateral element and at the downstream end on a support which is vertically movable in a guide supported by said corresponding beam, and vertical displacement of each said downstream support is directly and proportionally tied to transverse displacement of said corresponding lateral element relative to said corresponding beam.

4 Claims, 4 Drawing Figures

CARDBOARD BLANK FOLDING MACHINE

The present invention concerns improvements in machines for folding sheets of cardboard, particularly but not exclusively for folding up the blanks of packing cartons of corrugated cardboard.

The increase in the use of corrugated cardboard packing cartons requires faster and faster rates of production. The machines are capable of producing cartons at a great rate, starting from a sheet of card roughly in the form of the blank for the carton. These machines are becoming more and more continuous in their action, with the roughly shaped blank passing successively from stage to stage without intermediate stockpiling. The blank is thus impressed, cut to form rebates and auxiliary cut-outs, gummed on its closing faces, folded and struck together, and finally packed for delivery to the customer. Continuous production on such a machine has the disadvantage of requiring the machinery at all the stages to be reset to correspond whenever the dimensions of the finished product are changed. One thus progresses from motorisation to automation, and then to preselection of the settings of the cutting machine which is coupled to correspondingly set the "folder" and the "slotter impresser" which performs the cutting out and impressing.

In the folding part of the machine, the extreme transverse panels of the shaped blank are folded towards the middle and glued one to the other. The folding is generally performed with the box blanks being conveyed along longitudinal "folding beams" which support the blank along the folding lines in such a fashion that while holding the central part, the extreme panels can be supported upon inclined bars which move them up or down, depending upon whether the fold is upwards or downwards. The extreme panels can thus be brought to the vertical where they are then engaged by other bars which complete the fold to the horizontal. At the entry to the machine, where the card blank is still flat, the extreme edges pass between lateral elements, called pasters, because one of these elements carries the device for applying adhesive to the area of the closure. It is these longitudinal folding beams and the lateral pasting elements which must be displaced transversely at the same time as the cutting parts of the slotter in order to adapt to the corresponding dimensions of the carton.

It will be appreciated that the inclinations of the folding bars, whether vertical or transversal, must also be modified at each change of dimensions of the carton being made. In existing machines, each folding bar is attached to the longitudinal folding beam situated on the same side of the machine, by means of supports that can be pivoted and can slide and for each new dimension of carton, it is necessary to find, by trial and error, the best position for these supports to make the desired fold in the panel which rests upon it. This is a relatively long operation which above all needs the attention of a qualified person and is not readily capable to automation. In practice this operation must be performed twice for each new setting of the machine, since the two extreme panels of a carton are generally of different dimensions for the most usual cartons having rectangular bases.

It is an object of the invention to provide a device which overcomes the above disadvantage and which automatically adjusts the position of the folding bars to the dimensions of the extreme panels concerned, at the same time that the transverse setting of the beams and the lateral elements of the folder is adjusted.

According to the invention there is provided in a machine for folding a cardboard blank, in which a flat blank with fold lines impressed into it enters said machine and extreme lateral panels of said blanks are folded towards the centre of said blank along said fold lines, said machine comprising:

means for advancing said blanks in the direction of extent of said fold lines, two longitudinal beams disposed one on each side of said machine, means permitting transverse movement of said beams to enable said beams to be set transversely according to the dimensions of said blank at right angles to said fold lines, two lateral elements disposed one on each side of said machine, means permitting transverse movement of said elements to enable said elements to be set transversely according to said dimensions of the blank and adjacent the lateral edges of said blank before folding, two folding bars disposed one on each side of said machine, each said bar forming a ramp, inclined to the horizontal and vertical planes, for forcing said extreme lateral panel to fold itself along said fold line as said blank advances in the machine, the improvement wherein each folding bar is supported upstream by a support means fixed to said corresponding lateral element and downstream by a support means which is movable vertically in a guide supported by said corresponding beam, and vertical displacement of each said movable downstream support means is directly and proportionally tied to transverse displacement of said corresponding lateral element relative to said corresponding beam.

In a preferred embodiment of the invention each said downstream support means is suspended from one end of a cable, the other end of which is tied to said corresponding transverse element via return pulleys, one of which is fixed to said beam such that said cable extends substantially perpendicularly from a point of attachment to said lateral element to said one pulley.

The invention will be more fully understood from the following description of an embodiment thereof, given by way of example only, with reference to the accompanying drawings.

In the drawings:

FIG. 3 is a lateral elevation along the line III—III of FIG. 2.

Figure 1:
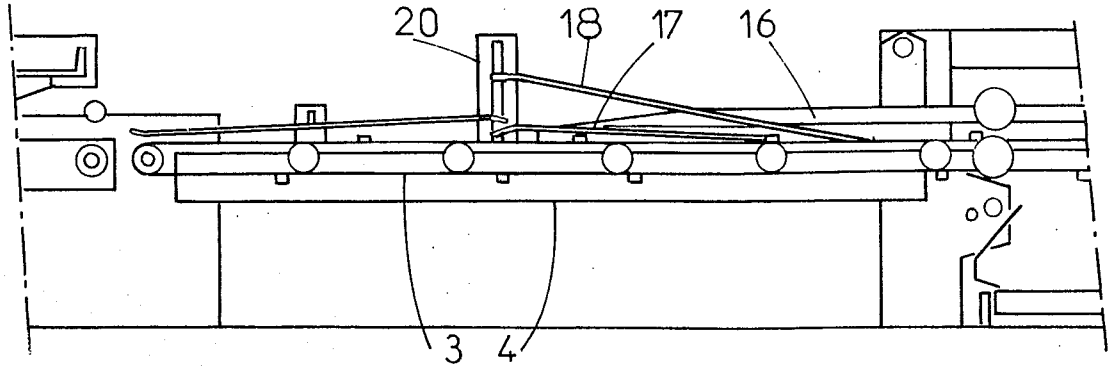
FIG. 1 is a simplified longitudinal sectional view of the folding part of a machine for making cardboard packing cartons.
Figure 2:
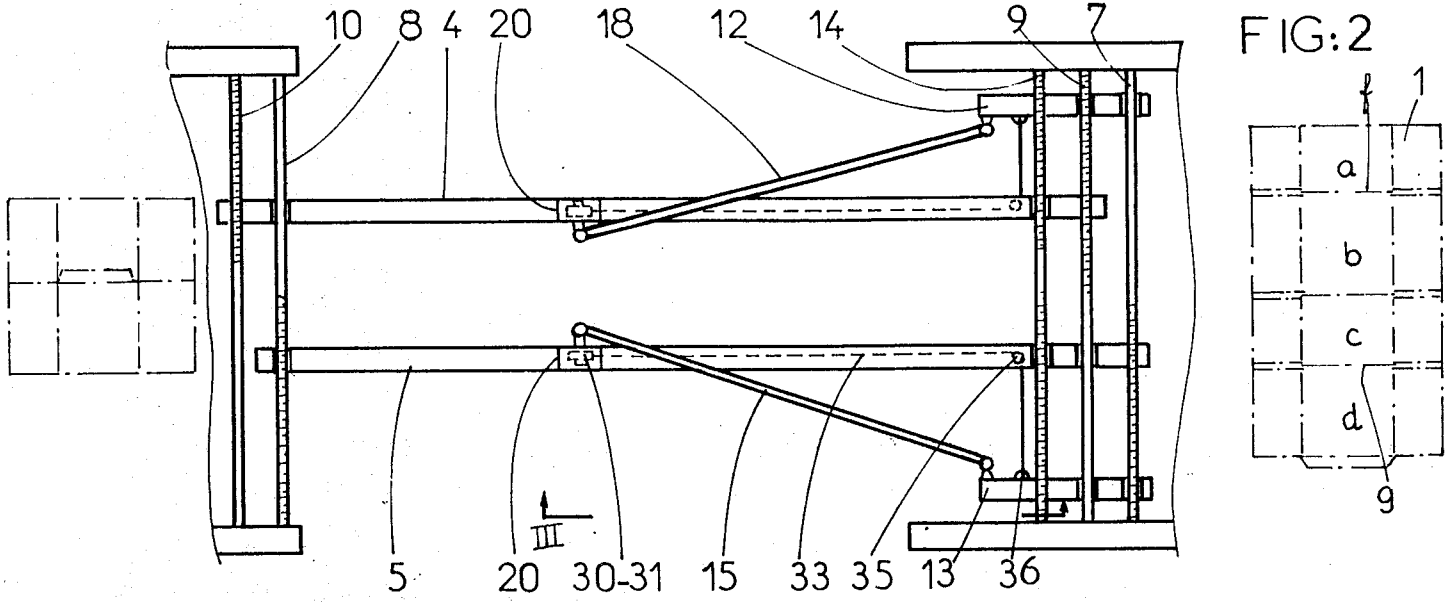
FIG. 2 is an even more simplified plan view of the machine part of FIG. 1.

Referring to FIGS. 1 and 2, blanks for cardboard packing cartons enter into the folding part of the machine in the form of a flat sheet 1, coming from the slotter part of the machine where the cutting and impressing have been done. The flat blanks are brought into the folding part of the machine by known arrangement of endless belts and pressure fingers which have been shown only in simplified fashion at 3 in FIG. 1.

The driving arrangements are mounted on two longitudinal folding beams 4 and 5 which serve to support the folding lines of the carton blank. As shown the extreme panels *a* and *d* of blank 1 are to be folded towards the centre along fold lines *f* and *g*. The blank must thus be held along lines *f* and *g*. The beams 4 and 5 are set separately, in appropriate transverse positions, respectively by means of screws 7 and 8, and screws 9 and 10 which extend at right angles to the folding lines *f* and *g*. At the entry to the machine, the extreme edges of the blank also have to be supported. This is done by lateral elements 12 and 13 which can be similarly set in position by means of the double screw 14. It is observed that, whatever the actual dimensions of the carton may be, for a rectangular carton, panels *b* and *d* are equal, and similarly panels *a* and *c* are equal. The result of this is that the fold line separating panels *b* and *c* is always disposed along the central axis of the machine, and that the extreme edges of the panels *a* and *d* are always disposed symmetrically with regard to the central axis of the machine. Therefore, the transverse displacement of the lateral elements 12 and 13 can be made by the same screw 14 with opposite screw-threads, whilst the elements 4 and 5 must be displaced independently of each other. It is observed that the relative distance between the lateral element 13 and the beam 5 corresponds to the transverse dimension of panel *d*, just as the distance between element 12 and beam 4 reflects the transverse dimension of panel *a*.

The elements 12 and 13 are often called pasting supports because one of them, often in interchangeable fashion, supports a gluing device which applies adhesive to the area of the closure.

In the case of a combined machine directly coupled to a slotter, the transverse setting of the elements 4, 5, 12 and 13 is carried out at the same time as the setting of the cutting mechanisms of the slotter by mechanical coupling of the rotary movements of screws 7, 8, 9, 10 and 14 with similar controls of the slotter.

In the course of its movement through the machine, the edge of panel *d*, for example, encounters oblique folding bar 15 which forces it to bend upwards, the folding line *g* being held by guide strips 16. Overall, the precision of the fold in the neighbourhood of line *g* is assured by a complementary guide in the form of an auxiliary folding bar 17 which is fixed. The same arrangement is provided on the other side of the machine for the panel *a* which is folded by bar 18.

Figure 3:
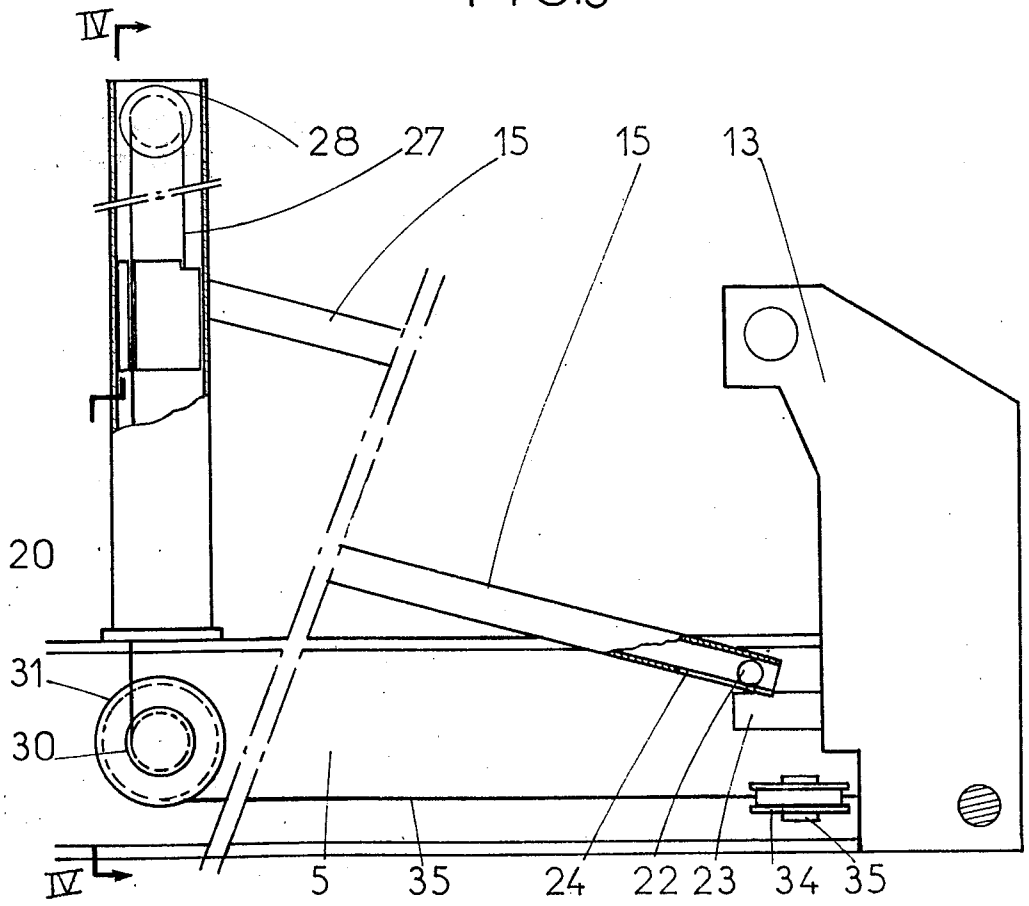
FIG. 3 shows the arrangements for setting a folding bar.
Figure 4:
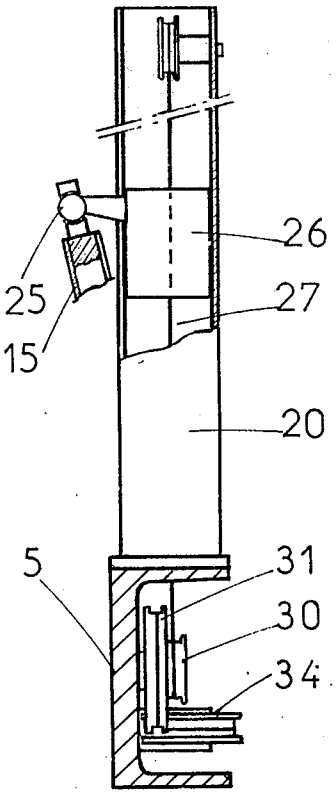
FIG. 4 is a section along the line IV—IV of FIG. 3.

We refer now to the drawings for the description of the two points of support for folding bar 15, one being "upstream" on lateral element 13, the other being "downstream" on a column 20 supported by beam 5. Referring to FIG. 3, the upstream support of bar 15 is constituted by a ball 22 carried by a support 23 fixed on the lateral element 13. The folding bar 15 is constituted by a tube 24, split at the end and engaged on the ball 22 so that the neck joining ball 22 to its support 23 passes through the split in the tube 24. It is seen that the tube can pivot in different directions in relation to support 23 and that it can slide upon ball 22. At its downstream end, tube 15 is tied by a ball-and-socket joint 25 to a supporting member 26 which is vertically movable in column 20. The supporting member 26 is suspended at the end of cable 27 which passes over a return pulley 28 at the upper end of column 20, and is then wrapped around a pulley 30. This latter is fixed to another pulley 31 of larger diameter around which is similarly wrapped another cable 33 which runs along the length of beam 5 and then passes around a return pulley 34 carried with its axis vertical on supports 35 fixed to beam 5, the end of cable 33 being fixed at 36 to element 13.

It can be seen that if it is desired to set a larger dimension for panel *d*, the distance between element 13 and beam 5 has to be increased. This exerts a pull on cable 33 which then rotates double pulley 30, 31 in the direction causing a tension in cable 27 and the raising of support 26 and the ball-and-socket joint 25. If the distance is decreased, support 26 acts as a counterweight, any reduction in the relative distance between element 13 and beam 5 producing a lowering of the downstream joint 25 of the folding bar 15.

Thus it can be seen that it is not necessary to make any manual adjustment of folding bar 15 because its vertical and transverse inclination is varied by the relative transverse displacement of the lateral element 13 and the folding beam 5. As shown, the vertical displacement of the downstream joint 25 of the bar 15 is proportional to the transverse displacement of the upstream support 22 in the ratio of the diameters of the pulleys 30 and 31. The articulation of the joint 25 together with the sliding articulation of ball 22 allows the bar to be located in a new position automatically without risk of jamming.

It will be understood, the invention is not strictly limited to the embodiment which has been described above, but it covers equally other embodiments which differ only by variations of execution or by the use of equivalent means. It will be appreciated that it is not necessary to have two return pulleys 30, 31 of different diameters, a single cable could be used running from transverse element 13 to the movable support 26. The ratio between the displacements of the upstream support and the downstream support of the folding bar can be chosen as a function of the nature of the cardboard of the cartons generally made on the machine, and it will suffice to give the same ratio to the diameters of the pulleys 30 and 31.

It will be appreciated that the control of the vertical movement of the downstream support of the folding bar in relation to the transverse movement of the upstream support could be effected for instance by a device such as a toothed rack connected to the transverse element 13 which causes rotation of a shaft parallel to beam 5 and which controls vertical movement of support 26 by another arrangement of cables and pulleys, or by a screw arrangement or by any other mechanical device.

What is claimed is:

1. In a machine for folding a cardboard blank, in which a flat blank with fold lines impressed into it enters said machine and extreme lateral panels of said blanks are folded towards the centre of said blank along said fold lines, said machine comprising:

means for advancing said blanks in the direction of extent of said fold lines, two longitudinal beams disposed one on each side of said machine, means permitting transverse movement of said beams to enable said beams to be set transversely according to the dimensions of said blank at right angles to said fold lines, two lateral elements disposed one on each side of said machine, means permitting transverse movement of said elements to enable said elements to be set transversely according to said dimensions of the blank and adjacent the lateral edges of said blank before folding, two folding bars disposed one on each side of said machine, each said bar forming a ramp, inclined to the horizontal and vertical planes, for forcing said extreme lateral panel to fold itself along said fold line as said blank advances in the machine, the improvement wherein each folding bar is supported upstream by a support means fixed to said corresponding lateral element and downstream by a support means which is movable vertically in a guide supported by said corresponding beam, and vertical displacement of each said movable downstream support means is directly and proportionally tied to transverse displacement of said corresponding lateral element relative to said corresponding beam.

2. The improvement according to claim 1, wherein each said downstream support means is suspended from one end of a cable, the other end of which is tied to said corresponding transverse element via return pulleys, one of which is fixed to said beam (5) such that said cable extends substantially perpendicularly from a point of attachment to said lateral element to said one pulley.

3. The improvement according to claim 2, wherein each said cable is in two parts which are interconnected by a differential pulley which introduces a constant ratio between displacement of said respective movable support and displacement of said corresponding lateral element relative to said corresponding beam.

4. The improvement according to claim 1, wherein each said lateral element carries a toothed rack extending perpendicular to said corresponding beam, and which engages a pinion fixed to a shaft which is parallel to said beam and provided at its outer end with means to cause the vertical movement of said downstream support means proportional to rotation of said shaft.

* * * * *